US009625133B2

(12) United States Patent
Mandy et al.

(10) Patent No.: US 9,625,133 B2
(45) Date of Patent: Apr. 18, 2017

(54) LIGHT FIXTURE MOUNTING METHOD AND ASSEMBLY

(75) Inventors: Terry Roy Mandy, Paradise Valley, AZ (US); Dalton John Mandy, Scottsdale, AZ (US); Brandon Roy Mandy, Scottsdale, AZ (US)

(73) Assignee: Mandy Holdings LLLP, Scottsdale, AZ (US)

( * ) Notice: Subject to any disclaimer, the term of this patent is extended or adjusted under 35 U.S.C. 154(b) by 1155 days.

(21) Appl. No.: 12/795,899

(22) Filed: Jun. 8, 2010

(65) Prior Publication Data

US 2011/0299290 A1 Dec. 8, 2011

(51) Int. Cl.
*F21V 21/04* (2006.01)

(52) U.S. Cl.
CPC ..... *F21V 21/04* (2013.01); *Y10T 29/49826* (2015.01)

(58) Field of Classification Search
CPC ..... F21S 8/026; F21V 21/04
USPC ..... 362/366
See application file for complete search history.

(56) References Cited

U.S. PATENT DOCUMENTS 6,474,846 B1 * 11/2002 Kelmelis ..... F21V 17/164 248/231.91
6,994,457 B2 2/2006 Lee

OTHER PUBLICATIONS

Installation guide for IP110-F Flush Mount Adapter, Pelco, Inc., Dec. 2008, C2238M.

* cited by examiner

*Primary Examiner* — Nimeshkumar Patel
*Assistant Examiner* — Christopher Raabe
(74) *Attorney, Agent, or Firm* — Reising Ethington P.C.

(57) ABSTRACT

An assembly for mounting a light fixture in a hole in a ceiling panel and including an annular trim ring that's held upward against a lower surface of a ceiling panel by the light fixture to be mounted, such that the trim ring spans an annular gap between such light fixture and the ceiling panel hole. A top plate is carried by the ceiling panel across the ceiling panel hole and includes a top plate hole that receives the light fixture to be mounted such that the top plate spans an annular gap between the light fixture and the ceiling panel hole. A mount supports the light fixture on the top plate in a position holding the trim ring up against the lower surface of the ceiling panel.

20 Claims, 3 Drawing Sheets

LIGHT FIXTURE MOUNTING METHOD AND ASSEMBLY

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

This invention relates generally to the mounting of a light fixture in a hole in a ceiling panel.

Description of the Related Art Including Information Disclosed Under 37 CFR 1.97 and 1.98

It's known to suspend a light fixture in a hole cut in ceiling panel where the ceiling panel holes are larger in diameter than the light fixture. For example, an installation manual for a Pelco, Inc. flush mount adapter discloses a device that suspends a smaller diameter fixture within a larger diameter ceiling panel hole using an annular trim ring that's held up against a lower surface of the ceiling panel. The annular trim ring is fixed to the fixture and is suspended by rods from spring paddles that rest on an upper surface of the ceiling panel.

Also, U.S. Pat. No. 6,994,457 B2 issued 7 Feb. 2006 to Lee discloses a recessed down light fixture 57 that's suspended in a larger diameter ceiling panel hole by upper and lower annular flanges 18, 40 that engage respective upper and lower surfaces of the ceiling panel 94 around the hole. Both the upper flange 18 and the lower flange 40 are fixed to the light fixture 57, with the upper flange 18 being carried by an internally threaded outer ring 12 of the fixture 57, which is threadedly engaged with and axially moveably adjustable along an externally threaded middle ring 14 of the fixture 57.

BRIEF SUMMARY OF THE DISCLOSURE

A light fixture mounting assembly is provided for mounting a light fixture in a hole in a ceiling panel. The assembly may include an annular trim ring configured to be held upward against a lower surface of a ceiling panel by a light fixture to be mounted within a ceiling panel hole in the ceiling panel such that the trim ring spans an annular gap between such light fixture and the ceiling panel hole. The assembly may also include a top plate configured to be carried by the ceiling panel across the ceiling panel hole. The top plate may have a top plate hole configured to receive a light fixture to be mounted, such that the top plate spans an annular gap between such light fixture and an upper edge of the ceiling panel hole. The assembly may further include a mount configured to support the light fixture on the top plate in a position holding the trim ring up against the lower surface of the ceiling panel so that a light fixture can be mounted in a ceiling panel hole cut to fit a light fixture of greater circumference or diameter than the light fixture, and so that, in replacing a larger diameter light fixture, there's no need to replace the ceiling panel and cut a new, smaller hole.

The trim ring may have a trim ring hole configured to receive a generally cylindrical portion of a light fixture to be mounted. The trim ring hole may be further configured to engage a circumferential flange that extends radially outwardly from the light fixture.

The trim ring hole may be generally circular and may be defined by a trim ring inner diameter less than an outer diameter of the circumferential flange of a light fixture to be mounted and greater than the diameter of such a light fixture so that the light fixture can be received in the trim ring hole and the trim ring carried by the circumferential flange of the light fixture.

The trim ring hole may be generally circular and may be disposed concentrically relative to the trim ring outer diameter so that the light fixture will be carried concentrically or coaxially within the ceiling panel hole.

The trim ring outer and inner diameters may be sufficient to span an annular gap between an outer edge of the circumferential flange of a light fixture to be mounted and the lower edge of a ceiling panel hole in which the light fixture is to be mounted.

The top plate may be sized to rest on an upper surface of a ceiling panel across a ceiling panel hole axially opposite the trim ring, may be polygonal in shape, and may have at least a diagonal width greater than an least one dimension of the ceiling panel hole. The top plate may be square.

The top plate hole may be generally circular and may have a diameter slightly greater than that of a light fixture to be mounted, so as to receive the light fixture and allow the top plate to span an annular gap between a light fixture to be mounted and a ceiling panel hole in which such light fixture is to be mounted.

The mount may be configured to removably support a light fixture on the top plate and may be configured to support a light fixture in an axial position relative to a ceiling panel hole.

The mount may be configured to support a light fixture having a circumferential flange extending radially outward from a generally cylindrical housing in a position to engage and hold the trim ring up against the lower surface of the ceiling panel.

The mount may include a projection that, when the mount is installed, is attached to and extends from a light fixture to be mounted, and rests on an upper surface of the top plate, suspending such light fixture in a ceiling hole.

The mount may include at least two projections that, when installed, are attached to and extend from circumferentially spaced locations around a light fixture to be mounted, and rest on an upper surface of the top plate, suspending such light fixture in a ceiling panel hole.

The at least two projections may comprise angle brackets comprising respective vertical portions that, when installed, are attached to such light fixture. The projections may further comprise respective horizontal portions that extend radially outwardly and rest on the upper surface of the top plate, suspending the light fixture in the ceiling panel hole. The respective vertical portions of the angle brackets may be strapped to such light fixture.

The mount may alternatively include at least two resilient engagement members carried by the fixture and arranged such that free ends of the engagement members are biased radially outward from the fixture so as to be radially inwardly compressible as the fixture is passed upward through the top plate and engageable with an upper surface of the top plate to support the fixture on the top plate and to hold the trim ring up against the lower surface of a ceiling panel upon which the light fixture is being mounted.

The mount may alternatively include external threading on the fixture and internal threading on the top plate configured to threadedly engage the external threading on the fixture to support the fixture on the top plate and hold the trim ring up against the lower surface of a ceiling panel upon which the light fixture is being mounted.

The mount may alternatively include a nut plate carried by the top plate and including an internally threaded hole coaxially aligned with the top plate hole and configured to threadedly engage the external threading on the fixture.

A method is provided for mounting a light fixture in a hole in a ceiling panel. According to the method, one can mount a light fixture in a hole in a ceiling panel by providing a light fixture, a ceiling panel having a ceiling panel hole larger in circumference or diameter than the fixture, and a light fixture mounting assembly that may include an annular trim ring that has an outer circumference or diameter larger than the circumference or diameter of the ceiling panel hole and that has a trim ring hole large enough to receive the light fixture. The mounting assembly may further comprise a top plate that's large enough to span the ceiling panel hole and that has a top plate hole large enough to receive the light fixture. The trim ring may be supported on the light fixture by passing the light fixture upward through the ceiling panel hole and supporting the light fixture on the top plate in a position holding the trim ring up against the lower surface of the ceiling panel.

The light fixture mounting assembly may be provided to include a mount, and the step of supporting the light fixture may include using the mount to support the light fixture on the top plate in a position holding the trim ring up against the lower surface of the ceiling panel. The mount may further be provided to include at least two projections and the step of using the mount may include strapping the projections to the light fixture.

BRIEF DESCRIPTION OF THE SEVERAL VIEWS OF THE DRAWINGS

These and other features and advantages will become apparent to those skilled in the art in connection with the following detailed description and drawings of one or more embodiments of the invention, in which.

DETAILED DESCRIPTION OF INVENTION EMBODIMENT(S)

Figure 1:
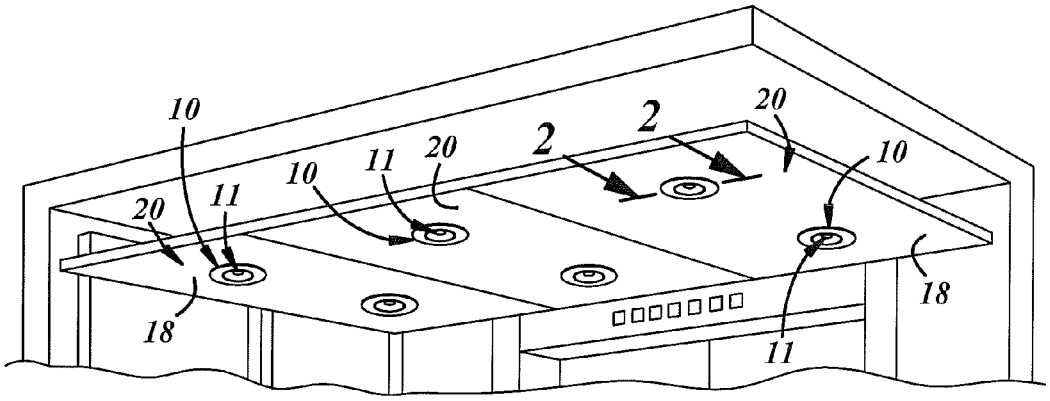
FIG. 1 is a fragmentary cutaway perspective view of an elevator cab interior showing several elevator light fixture installations, each including a light fixture mounting assembly carrying a light fixture in a drop ceiling panel of the elevator cab.
Figure 2:
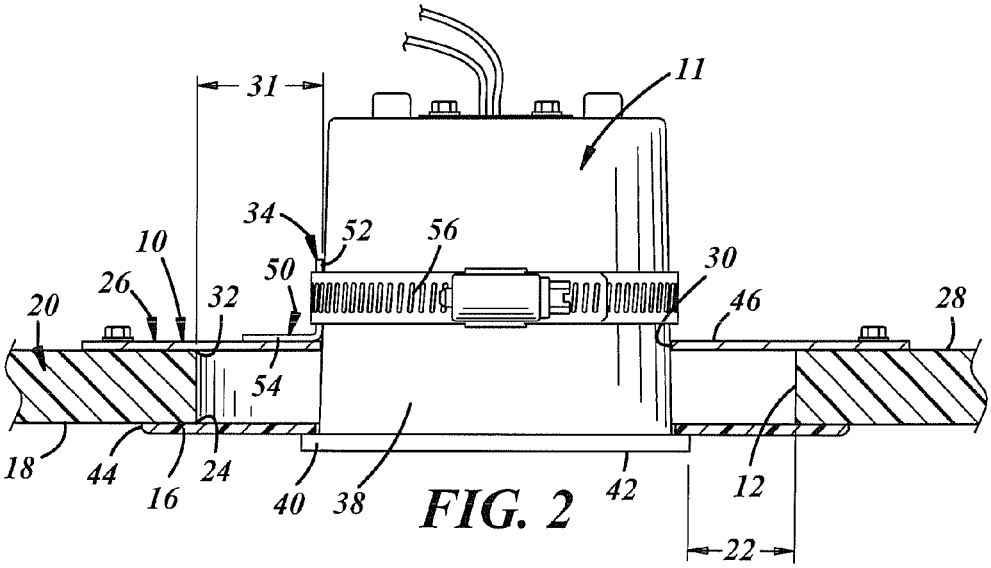
FIG. 2 is a cross-sectional front view of one of the elevator light fixture installations of FIG. 1 taken along line 2-2 of FIG. 1 and showing a light fixture assembly carrying a light fixture in a drop ceiling panel of the elevator cab.
Figure 3:
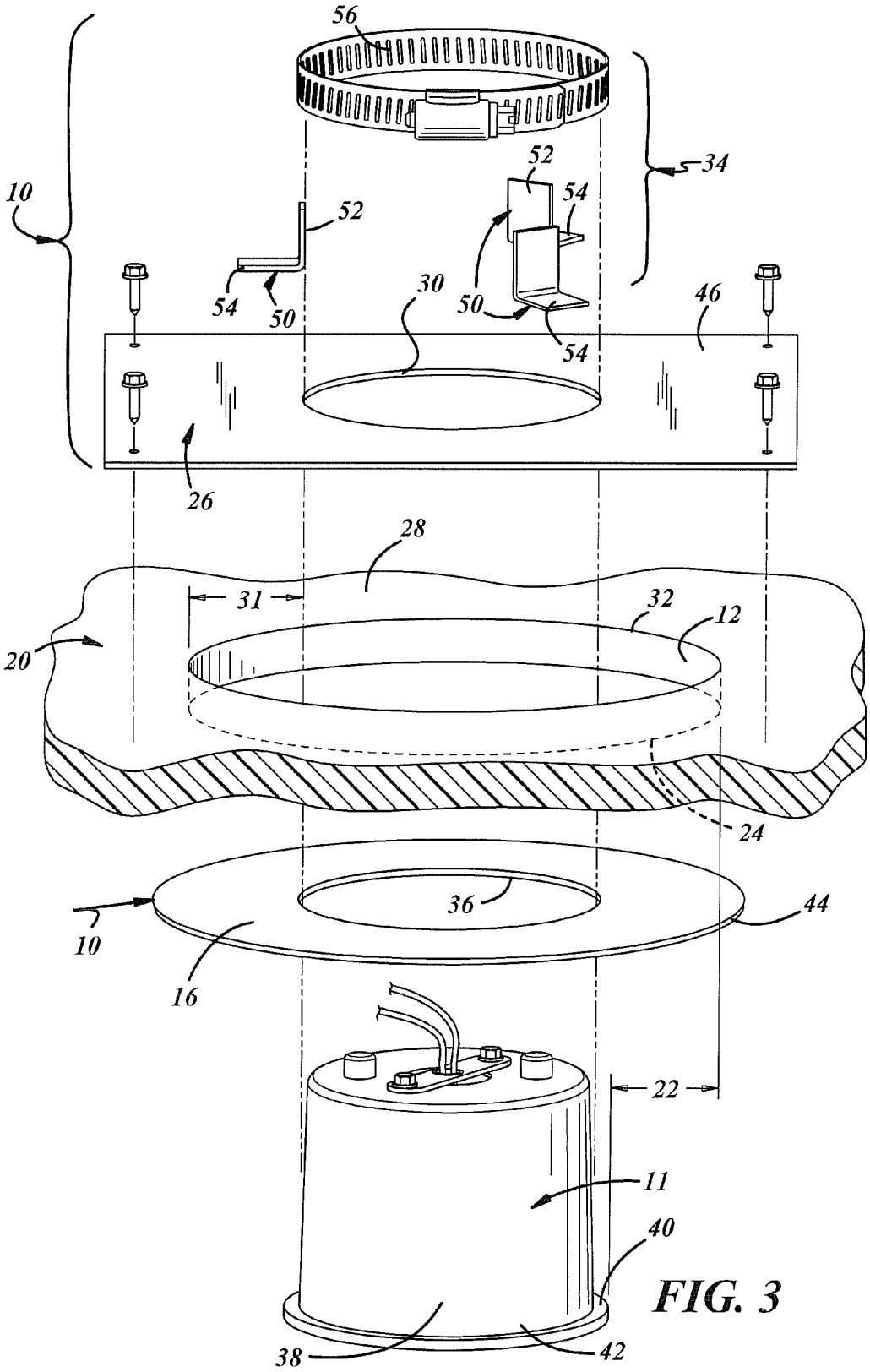
FIG. 3 is an exploded view of one of the elevator light fixture installations of FIG. 1.

A light fixture mounting assembly 10 for mounting a light fixture 11 in a hole 12 in a ceiling panel 20 is generally indicated at 10 in FIGS. 1-3. A second embodiment is generally shown at 10' in FIG. 4 and a third embodiment is generally shown at 10" in FIG. 5. Reference numerals with the designations prime (') in FIG. 4 and double-prime (") in FIG. 5 indicate alternative configurations of elements that also appear in the first embodiment of FIGS. 1-3. Unless indicated otherwise, where a portion of the following description uses a reference numeral to refer to FIGS. 1-3, that portion of the description applies equally to elements designated by primed numerals in FIG. 4 and double-primed numerals in FIG. 5.

As best shown in FIGS. 2 and 3, the assembly 10 may include an annular trim ring 16 that may be configured to be held upward against a lower surface 18 of a ceiling panel 20 by a light fixture 11 to be mounted within a ceiling panel hole 12 in the ceiling panel 20 such that the trim ring 16 spans an annular gap 22 between such light fixture 11 and a lower edge 24 of the ceiling panel hole 12. The assembly 10 may also include a top plate 26 that's configured to be carried by the ceiling panel 20 on an upper surface 28 of the ceiling panel 20 across the ceiling panel hole 12. The top plate 26 may include a top plate hole 30 that may be configured to receive a light fixture 11 to be mounted, such that the top plate 26 spans an annular gap 31 between such light fixture 11 and an upper edge 32 of the ceiling panel hole 12. The assembly 10 may also include a mount 34 configured to support such a light fixture 11 on the top plate 26 in a position holding the trim ring 16 up against the lower surface 18 of the ceiling panel 20. This arrangement allows a light fixture 11 to be mounted in a ceiling panel hole 12 cut to fit a light fixture 11 of greater circumference or diameter than the light fixture 11, and so that, when replacing a larger diameter light fixture with a smaller diameter light fixture 11, there's no need to replace the ceiling panel 20 and cut a new, smaller ceiling panel hole. In the present embodiment the assembly 10 allows retrofit of a generally cylindrical light fixture 11 sized to fit in a 7 cm (2¾") diameter ceiling panel hole, into an 11.4 cm (4½") diameter ceiling panel hole 12 that was cut to receive a larger diameter light fixture, The trim ring 16 may have a trim ring hole 36 that may be configured to receive a generally cylindrical portion 38 of a light fixture 11 to be mounted, and that may be further configured to engage a circumferential flange 40 that extends radially outwardly from around a generally cylindrical lower end 42 of such a light fixture 11. The trim ring 16 may, as in the present embodiment, have a 13.6 cm (5⅜") outer diameter and a 7 cm (2¾") diameter trim ring hole 36 to accommodate and receive a generally cylindrical 7 cm (2¾") diameter portion 38 of a light fixture 11 to be mounted.

As best shown in FIG. 3, the trim ring hole 36 may be generally circular and may be defined by a trim ring inner diameter 36 that's less than an outer diameter of the circumferential flange 40 of a light fixture 11 to be mounted, and that's greater than the diameter of the generally cylindrical lower end 42 of such a light fixture 11. This allows the light fixture 11 to be received in the trim ring hole 36 and the trim ring 16 carried by the circumferential flange 40 of the light fixture 11.

As is also best shown in FIG. 3, the trim ring hole 36 may be disposed concentrically relative to an outer circumferential edge 44 of the trim ring 16. This allows the light fixture 11 to be carried concentrically or coaxially within the ceiling panel hole 12. However, in other embodiments, the trim ring hole 36 may be other than circular to accommodate different light fixture shapes and may be disposed eccentrically where it's desirable to locate a light fixture other than concentrically within a ceiling panel hole 12.

The outer and inner diameters of the trim ring 16 may be of a magnitude sufficient to span the annular gap 22 between the circumferential flange 40 of a light fixture 11 to be mounted and the lower edge 24 of a generally circular ceiling panel hole 12 in which the light fixture 11 is to be mounted. In the present embodiment, the 7 cm (2¾") inner diameter of the trim ring 16 is smaller than a 7.7 cm (3") diameter outer edge of the circumferential flange 40 of an elevator light fixture made by the assignee of the present invention and sold under the trade name LED-DL®. Also in the present embodiment the 13.6 cm (5⅜") outer diameter of the trim ring is larger than the 11.4 cm (4½") diameter of a hole that would have been formed in an elevator ceiling panel to accommodate another elevator light fixture such as one made by the assignee of the present invention and sold under the trade name Linelite®.

As best shown in FIG. 2, the top plate 26 may be sized to rest on the upper surface 28 of a ceiling panel 20 across a ceiling panel hole 12 and axially opposite the trim ring 16. The top plate 26 may be polygonal in shape and may have at least a diagonal width greater than at least one dimension of a ceiling panel hole 12 that the top plate 26 is to span. In the present embodiment the top plate 26 is 14 cm (5½") square to allow the top plate 26 to span a ceiling panel hole such as an 11.4 cm (4½") diameter ceiling panel hole 12 originally cut to accommodate a Linelite® light fixture. While in the present embodiment the top plate 26 is generally square in shape, in other embodiments the top plate 26 may have any suitable shape and size sufficient to span a ceiling panel hole over which the plate 26 is to be installed.

As best shown in FIG. 3, the top plate hole 30 may be generally circular and may have a diameter slightly greater than that of a generally cylindrical portion 38 of a light fixture 11 to be mounted. This allows the top plate 26 to receive the generally cylindrical portion 38 of the light fixture 11 and allows the top plate 26 to span an annular gap 31 between a generally cylindrical portion 38 of a light fixture 11 to be mounted and a ceiling panel hole 12 in which such light fixture 11 is to be mounted. As with the trim ring hole, the top plate hole 30 may be located in a center of the top plate 26 so that, when the trim ring and mounting plate 26 are installed on a ceiling panel 20, the trim ring hole 36 and top plate hole 30 are concentrically and coaxially aligned with each other and/or with the ceiling panel hole 12. However, in other embodiments, and similar to the trim ring hole 36, the top mounting plate hole 30 may be other than circular to accommodate different light fixture shapes and may be disposed eccentrically within the top plate 26 and/or relative to the ceiling panel hole 12 where it's desirable to locate a light fixture other than concentrically within a ceiling panel hole 12.

The mount 34 may be configured in such a way as to be able to removably support a light fixture 11 on the top plate 26, and may be further configured to support a light fixture 11 in a position in axial alignment with a ceiling panel hole 12. In the embodiment of FIGS. 2 and 3, the mount 34 is configured to support a light fixture in concentric axial alignment with a ceiling panel hole 12, with a lower end of the light fixture 11 disposed within the ceiling panel hole 12.

Figure 4:
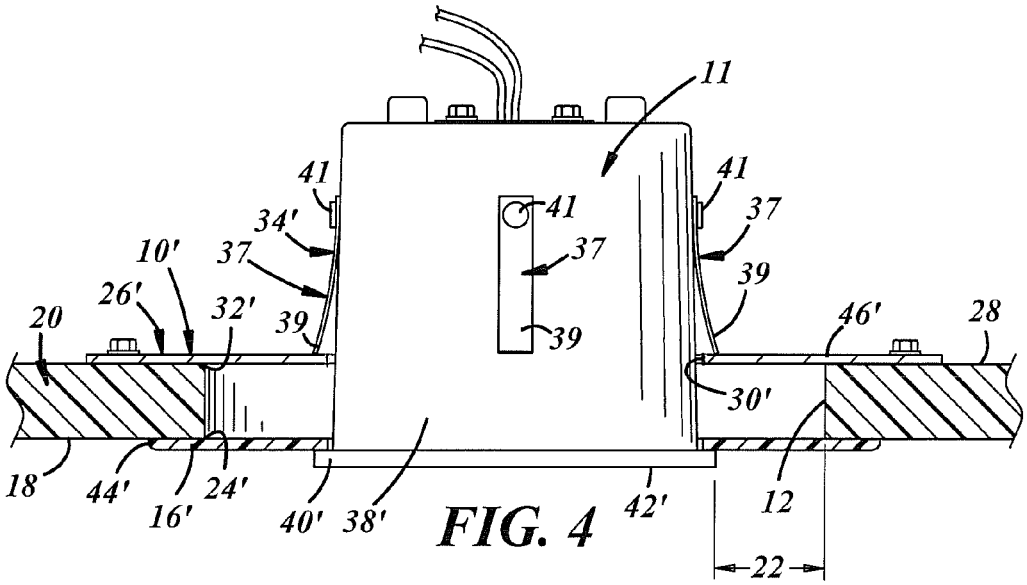
FIG. 4 is a cross-sectional front view of an elevator light fixture installation as shown in FIG. 1 taken along line 2-2 of FIG. 1 showing a light fixture assembly carrying a light fixture in a drop ceiling panel of the elevator cab and including an alternative mount arrangement.

As shown in the embodiment of FIG. 4, the mount 34' may alternatively include two or more resilient engagement members 37 that may be carried by the fixture 11'. As is also shown in FIG. 4 the resilient engagement members 37 may be arranged such that free ends 39 of the members 37 are biased radially outward from the fixture 11' so that they can be compressed radially inward as the fixture 11' is being passed upward through the trim ring 16' and the top plate 26' and will then spring radially outward to engage an upper surface 46' of the top plate 26' to support the fixture 11' on the top plate 26' and hold the trim ring 16' up against the lower surface 18 of a ceiling panel 20 upon which the light fixture 11' is being mounted. As shown in FIG. 4 the resilient engagement members 37 may include strips of a resilient material such as spring steel fastened to the light fixture 11 by rivets 41 or any other suitable known fastening means. In other embodiments, the resilient engagement members 37 may include coil springs or any other suitable known biasing means.

Figure 5:
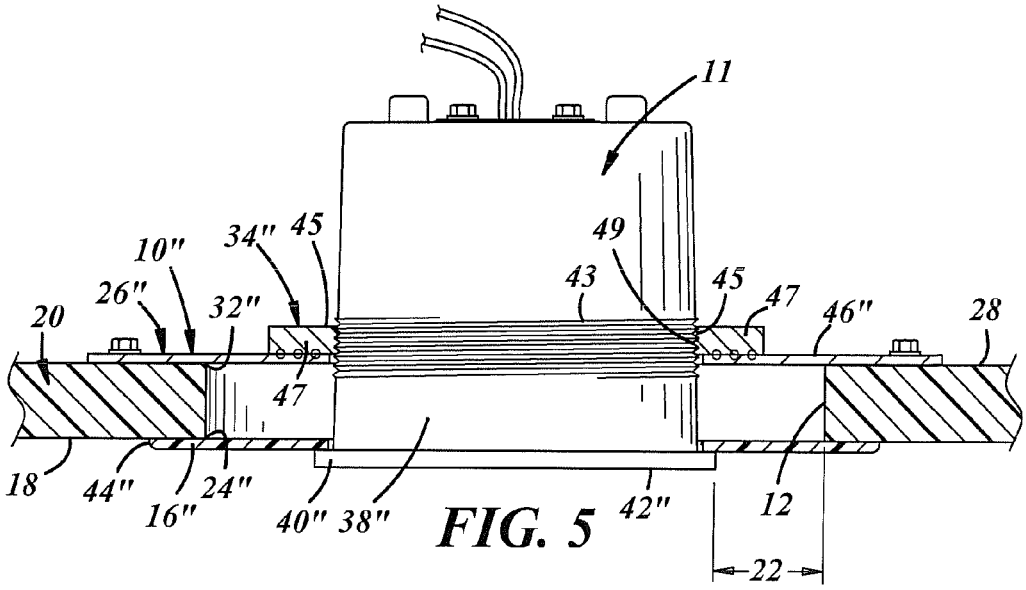
FIG. 5 is a cross-sectional front view of an elevator light fixture installation as shown in FIG. 1 taken along line 2-2 of FIG. 1 showing a light fixture assembly carrying a light fixture in a drop ceiling panel of the elevator cab and including an additional alternative mount arrangement.

As shown in the embodiment of FIG. 5, the mount 34" may alternatively include external threading 43 on the fixture 11" and internal threading 45 on the top plate 26" configured to threadedly engage the external threading 41 on the fixture 11". As is also shown in FIG. 5, the mount 34" may include an annular disk or nut plate 47 carried by the top plate 26 and including an internally threaded hole 49 coaxially aligned with the top plate hole 30" and configured to threadedly engage the external threading 41 on the fixture 11" to support the fixture 11" on the top plate 26" and hold the trim ring 16" up against the lower surface 18 of a ceiling panel 20 upon which the light fixture 11" is being mounted. The nut plate 47 may be fixed to the top plate 26 via welding or via any other known suitable means.

The mount 34 may be further configured to support a light fixture 11 that has a circumferential flange 40 extending radially outward from around a generally cylindrical housing of the light fixture 11 in a position relative to a ceiling panel hole 12 such that the trim ring 16 is engaged and held by the circumferential flange 40 up against the lower surface 18 of the ceiling panel 20 as shown in FIG. 2.

As shown in FIGS. 2 and 3, the mount 34 may include at least one projection 50 that, when installed, is attached to and extends radially outwardly from a light fixture 11 to be mounted, and rests on the upper surface 46 of the top plate 26, suspending such light fixture 11 in a ceiling panel hole 12 as shown in FIG. 2. Where the mount 34 includes at least two such projections 50, when installed, the projections 50 may be attached to and extend radially outwardly from circumferentially spaced locations around a light fixture 11 to be mounted, and rest on the upper surface 46 of the top plate 26, suspending such light fixture 11 in a ceiling panel hole 12. As shown in FIG. 3, the mount 34 may include three such projections 50, and they may comprise steel angle brackets that include respective vertical portions 52 and respective horizontal portions 54. As best shown in FIG. 2, when installed, the vertical portions 52 of the angle brackets may be attached to a light fixture 11 in respective positions where their respective horizontal portions 54 will extend radially outwardly and rest on the upper surface of the top plate 26, suspending the light fixture 11 in the ceiling panel hole 12. The horizontal portions 54 of the angle brackets may or may not be attached to the top plate 26. As is also shown in FIGS. 2 and 3, the respective vertical portions 52 of the angle brackets may be strapped to such light fixture 11 by a clamp strap 56. However, in other embodiments, any suitable means may be used to attach the projections 50 to a light fixture 11 to be mounted.

In practice, a light fixture 11 may be mounted in axial alignment with a hole 12 in a ceiling panel 20 by first providing a light fixture 11 to be mounted, providing a ceiling panel 20 having a ceiling panel hole 12 larger in circumference or diameter than the light fixture 11 to be mounted, and providing a light fixture 11 mounting assembly 10 as described above, i.e., an assembly 10 comprising an annular trim ring 16 having an outer circumference or diameter larger than the circumference or diameter of the ceiling panel hole 12 and having a trim ring hole 36 large enough to receive the light fixture 11; the assembly 10 further comprising a top plate 26 large enough to span the ceiling panel hole 12 and having a top plate hole 30 large enough to receive the light fixture 11. The trim ring may then be supported on the light fixture 11 by passing the light fixture 11 through the trim ring 16. The light fixture 11 may then be passed upward through the ceiling panel hole 12 until the trim ring 16 is carried by the circumferential flange 40 of the light fixture 11 into contact with a lower surface 18 of the ceiling panel 20. The light fixture 11 may then be supported on the top plate 26 in a position in which the circumferential flange 40 of the light fixture 11 is holding the trim ring 16 up against the lower surface 18 of the ceiling panel 20 IMS5.

Where the provided light fixture mounting assembly 10 includes at least one mount 34, when the light fixture 11 is supported on the top plate 26, the mount 34 to the light fixture 11 may be attached in a position on the light fixture 11 that supports the light fixture 11 on the top plate 26 in a position holding the trim ring 16 up against the lower surface of the ceiling panel 20. Where, as shown in FIGS. 2 and 3, the mount 34 includes at least two projections 50, the attachment of the at least two projections 50 may include strapping the projections 50 to the light fixture 11.

Thus, according to the apparatus and method described above, larger diameter light fixtures can be replaced with a smaller diameter light fixtures without having to replace ceiling panels that the larger diameter light fixtures were mounted in or cut new, smaller, holes in replacement ceiling panels.

This description, rather than describing limitations of an invention, only illustrates an embodiment of the invention recited in the claims. The language of this description is therefore exclusively descriptive and is non-limiting.

Obviously, it's possible to modify this invention from what the description teaches. Within the scope of the claims, one may practice the invention other than as described above.

What is claimed is:

1. A light fixture mounting assembly for mounting a light fixture in a hole in a ceiling panel, the assembly comprising:

an annular trim ring configured to be received on a light fixture to be mounted within a ceiling panel hole, and to engage and be carried by a flange extending laterally outward from the light fixture such that the flange holds the trim ring upward against a lower surface of the ceiling panel in a position disposed between the flange and the lower surface of the ceiling panel and spanning an annular gap between the flange and the ceiling panel hole when the light fixture is installed upward through the ceiling panel hole;

a top plate configured to be carried by the ceiling panel across the ceiling panel hole and having a top plate hole configured to receive a light fixture to be mounted within the ceiling panel hole, such that the top plate spans an annular gap between the light fixture and the ceiling panel hole; and a mount configured to support the light fixture on the top plate in a position holding the trim ring up against the lower surface of the ceiling panel.

2. A light fixture mounting assembly as defined in claim 1 in which the trim ring:

has a trim ring hole configured to receive a generally cylindrical portion of a light fixture to be mounted; and is configured to engage a circumferential flange that extends radially outwardly from such a light fixture.

3. A light fixture mounting assembly as defined in claim 2 in which the trim ring hole is generally circular and is defined by a trim ring inner diameter less than an outer diameter of the circumferential flange of a light fixture to be mounted and greater than a diameter of a generally cylindrical portion of such a light fixture from which the circumferential flange extends.

4. A light fixture mounting assembly as defined in claim 2 in which the trim ring hole is generally circular and is disposed concentrically relative to the trim ring outer diameter.

5. A light fixture mounting assembly as defined in claim 2 in which the trim ring outer and inner diameters are sufficient to span an annular gap between an outer edge of the circumferential flange of a light fixture to be mounted and the lower edge of a ceiling panel hole in which the light fixture is to be mounted.

6. A light fixture mounting assembly as defined in claim 1 in which the top plate is sized to rest on an upper surface of a ceiling panel across a ceiling panel hole axially opposite the trim ring.

7. A light fixture mounting assembly as defined in claim 1 in which the top plate is polygonal in shape and has at least a diagonal width greater than an least one dimension of the ceiling panel hole.

8. A light fixture mounting assembly as defined in claim 7 in which the top plate is square.

9. A light fixture mounting assembly as defined in claim 1 in which the top plate hole is generally circular and has a diameter slightly greater than a light fixture to be mounted and allowing the top plate to span an annular gap between a light fixture to be mounted and a ceiling panel hole in which such light fixture is to be mounted.

10. A light fixture mounting assembly as defined in claim 1 in which the mount is configured to removably support a light fixture on the top plate.

11. A light fixture mounting assembly as defined in claim 1 in which the mount is configured to support a light fixture in an axial position relative to a ceiling panel hole.

12. A light fixture mounting assembly as defined in claim 2 in which the mount is configured to support a light fixture having a circumferential flange extending radially outward from a generally cylindrical housing in a position to engage and hold the trim ring up against the lower surface of the ceiling panel.

13. A light fixture mounting assembly as defined in claim 12 in which the mount includes a projection that, when the mount is installed, is attached to and extends from a light fixture to be mounted, and rests on an upper surface of the top plate, suspending such light fixture in a ceiling panel hole.

14. A light fixture mounting assembly as defined in claim 12 in which the mount includes at least two projections that, when installed, are attached to and extend from circumferentially spaced locations around a light fixture to be mounted, and rest on an upper surface of the top plate, suspending such light fixture in a ceiling hole.

15. A light fixture mounting assembly as defined in claim 14 in which the at least two projections comprise angle brackets comprising:

respective vertical portions that, when installed, are attached to such light fixture; and respective horizontal portions that extend radially outwardly and rest on the upper surface of the top plate, suspending the light fixture in the ceiling panel hole.

16. A light fixture mounting assembly as defined in claim 15 in which the respective vertical portions of the angle brackets are strapped to such light fixture.

17. A light fixture mounting assembly as defined in claim 1 in which the mount includes at least two resilient engagement members carried by the fixture and arranged such that free ends of the engagement members are biased radially outward from the fixture so as to be radially inwardly compressible as the fixture is passed upward through the top plate and engageable with an upper surface of the top plate.

18. A light fixture mounting assembly as defined in claim 1 in which the mount includes:

external threading on the fixture; and internal threading on the top plate configured to threadedly engage the external threading on the fixture.

19. A light fixture mounting assembly as defined in claim 18 in which the mount includes a nut plate carried by the top plate and including an internally threaded hole coaxially aligned with the top plate hole and configured to threadedly engage the external threading on the fixture.

20. A light fixture mounting assembly as defined in claim 1 in which the trim ring is carried by the flange.

* * * * *